US009102427B2

(12) United States Patent
Hanna et al.

(10) Patent No.: US 9,102,427 B2
(45) Date of Patent: Aug. 11, 2015

(54) MULTI-POSITION HINGE

(75) Inventors: Thomas E. Hanna, Huntersville, NC (US); Joseph Dugan Musser, Huntersville, NC (US); Timothy M. Pierzynski, Apple Creek, OH (US); Robert John Warner, Jr., Charlotte, NC (US)

(73) Assignee: RUBBERMAID INCORPORATED, Huntersville, NC (US)

( * ) Notice: Subject to any disclaimer, the term of this patent is extended or adjusted under 35 U.S.C. 154(b) by 484 days.

(21) Appl. No.: 12/901,050

(22) Filed: Oct. 8, 2010

(65) Prior Publication Data

US 2011/0214400 A1 Sep. 8, 2011

Related U.S. Application Data

(60) Provisional application No. 61/250,196, filed on Oct. 9, 2009.

(51) Int. Cl.
*B65D 43/16* (2006.01)
*B65B 7/26* (2006.01)

(52) U.S. Cl.
CPC .. *B65B 7/26* (2013.01); *B65D 43/16* (2013.01)

(58) Field of Classification Search
CPC ..... B65F 1/1646; E05D 3/00; E05D 3/02; E05D 3/22
USPC ..... 220/831, 832, 908; 16/266, 268, 348, 16/350, 352
See application file for complete search history.

(56) References Cited

U.S. PATENT DOCUMENTS

| | | | | | |
|---|---|---|---|---|---|
| 92,662 | A | * | 7/1869 | Shepard et al. | 16/350 |
| 716,675 | A | * | 12/1902 | Crouch | 19/159 A |
| 2,397,070 | A | * | 3/1946 | Zublin | 166/50 |
| 3,359,028 | A | * | 12/1967 | Seckerson | 292/263 |
| 3,870,190 | A | * | 3/1975 | Tibbals, Jr. | 222/556 |
| 3,923,047 | A | * | 12/1975 | Chant | 602/16 |
| 4,782,435 | A | * | 11/1988 | Manzoni | 362/427 |
| 4,887,747 | A | * | 12/1989 | Ostrowsky et al. | 222/556 |
| 5,048,715 | A | * | 9/1991 | Wolff | 220/832 |
| 5,141,124 | A | * | 8/1992 | Smith et al. | 220/831 |
| 5,217,135 | A | * | 6/1993 | Smith et al. | 220/831 |
| 5,217,136 | A | * | 6/1993 | Sanden, Jr. | 220/836 |

(Continued)

FOREIGN PATENT DOCUMENTS

| | | |
|---|---|---|
| DE | 2033697 | 1/1972 |
| DE | 4018771 A1 | 12/1991 |
| FR | 2387865 | 11/1978 |

OTHER PUBLICATIONS

Instituto Mexicano De La Propiedad Industrial, Mexican Patent No. 275117, Mexican Office Action dated Sep. 14, 2009.

*Primary Examiner* — Fenn Mathew
*Assistant Examiner* — Chetan Chandra
(74) *Attorney, Agent, or Firm* — Marshall, Gerstein & Borun LLP

(57) ABSTRACT

A hinge comprises a post that forms a pivot axis for a lid. A ring portion is rotatably mounted on the post portion and comprises a hole having a recess extending from the periphery of hole where the hole receives the post. A pin on the post is dimensioned to fit into the recess when the recess rotates into alignment with the pin to lock the lid in an open position. The hinge may be used on a trash container that comprises a receptacle and a lid pivotably mounted to the receptacle at the hinge.

18 Claims, 12 Drawing Sheets

(56) References Cited

U.S. PATENT DOCUMENTS

| | | | | | |
|---|---|---|---|---|---|
| 5,529,205 | A * | 6/1996 | Corney et al. | 220/832 |
| 5,992,681 | A * | 11/1999 | Byrd et al. | 220/831 |
| 6,003,204 | A * | 12/1999 | Roach et al. | 16/267 |
| 6,053,354 | A * | 4/2000 | Niemeyer | 220/819 |
| 6,092,690 | A * | 7/2000 | Bitowft et al. | 220/831 |
| 6,145,856 | A * | 11/2000 | Conti | 280/47.26 |
| 6,338,181 | B1 * | 1/2002 | Hwang | 16/266 |
| 7,100,791 | B2 * | 9/2006 | Berger | 220/831 |
| 7,658,295 | B2 * | 2/2010 | Hoepner et al. | 215/237 |
| 8,206,058 | B2 * | 6/2012 | Vrondran et al. | 404/25 |
| 2007/0102391 | A1 * | 5/2007 | Hoepner et al. | 215/235 |
| 2009/0165813 | A1 * | 7/2009 | Sekine | 132/293 |
| 2010/0012671 | A1 * | 1/2010 | Vrondran et al. | 220/810 |

* cited by examiner

MULTI-POSITION HINGE

This application claims benefit of priority under 35 U.S.C. §119(e) to the filing date of to U.S. Provisional Application No. 61/250,196, as filed on Oct. 9, 2009, which is incorporated herein by reference in its entirety.

BACKGROUND

Covered containers such as refuse containers typically comprise a receptacle having a cover movably mounted to the receptacle. In one arrangement the cover is mounted to the receptacle at a hinge such that the cover pivots about the hinge relative to the receptacle. The cover may be rotated between a closed position where it rests on the rim of the container and a fully open position. In the fully open position the lid may hang vertically in a suspended fashion from the hinge along a back wall of the container.

SUMMARY OF THE INVENTION

A trash container comprises a receptacle and a lid pivotably mounted to the receptacle at a hinge. The hinge comprises a post that forms a pivot axis for the lid. A ring portion is rotatably mounted on the post portion and comprises a hole having a recess extending from the periphery of hole. The hole receives the post and a pin on the post is dimensioned to fit into the recess when the recess rotates into alignment with the pin such that engagement of the pin with the recess locks the lid in an open position relative to the receptacle.

The pin may have a first wall and a second wall each of the first wall and the second wall engaging a first sidewall and a second sidewall of the recess, the first wall being angled toward the second wall. The first sidewall and the second sidewall may be joined to the hole at rounded corners. Each of the first wall and the second wall may form an angle with a theoretical line that extends through the center of the post. The angle may be approximately 1 degree. The lid may be movable to a closed position when the pin is removed from the recess. The lid may rest on the receptacle in the closed position. The lid may be disposed vertically or near vertically in the open position. The lid may be spaced from the receptacle in the first open position. The lid may be movable to a second open position when the pin is removed from the recess. A force may be applied to the lid to remove the pin from the recess. The force may be applied perpendicularly to the lid. The receptacle may be mounted on a wheel and a handle may be mounted to the receptacle. The post may define a theoretical cylinder and the pin may be located within the theoretical cylinder.

A hinge may comprise a post portion that forms a pivot axis for a lid. A ring portion is rotatably mounted on the post portion and comprises a hole having a recess extending from the periphery of hole, the hole receiving the post portion. A pin on the post portion is dimensioned to fit into the recess when the recess rotates into alignment with the hinge pin such that engagement of the pin with the recess locks the lid in an open position relative to the receptacle.

A method of operating a lid pivotably attached to a receptacle comprises providing a hinge for connecting the lid to the receptacle comprising a post portion that forms a pivot axis for a lid; a ring portion rotatably mounted on the post portion comprises a hole having a recess extending from the periphery of hole, the hole receiving the post portion; and a pin on the post portion is dimensioned to fit into the recess when the recess rotates into alignment with the hinge pin; rotating the lid until the pin engages the recess to position the lid in a first open position; applying a force to the lid to force the pin out of engagement with the recess; rotating the lid until the lid is in a closed position or a second open position.

DETAILED DESCRIPTION OF EMBODIMENTS OF THE INVENTION

Figure 1:
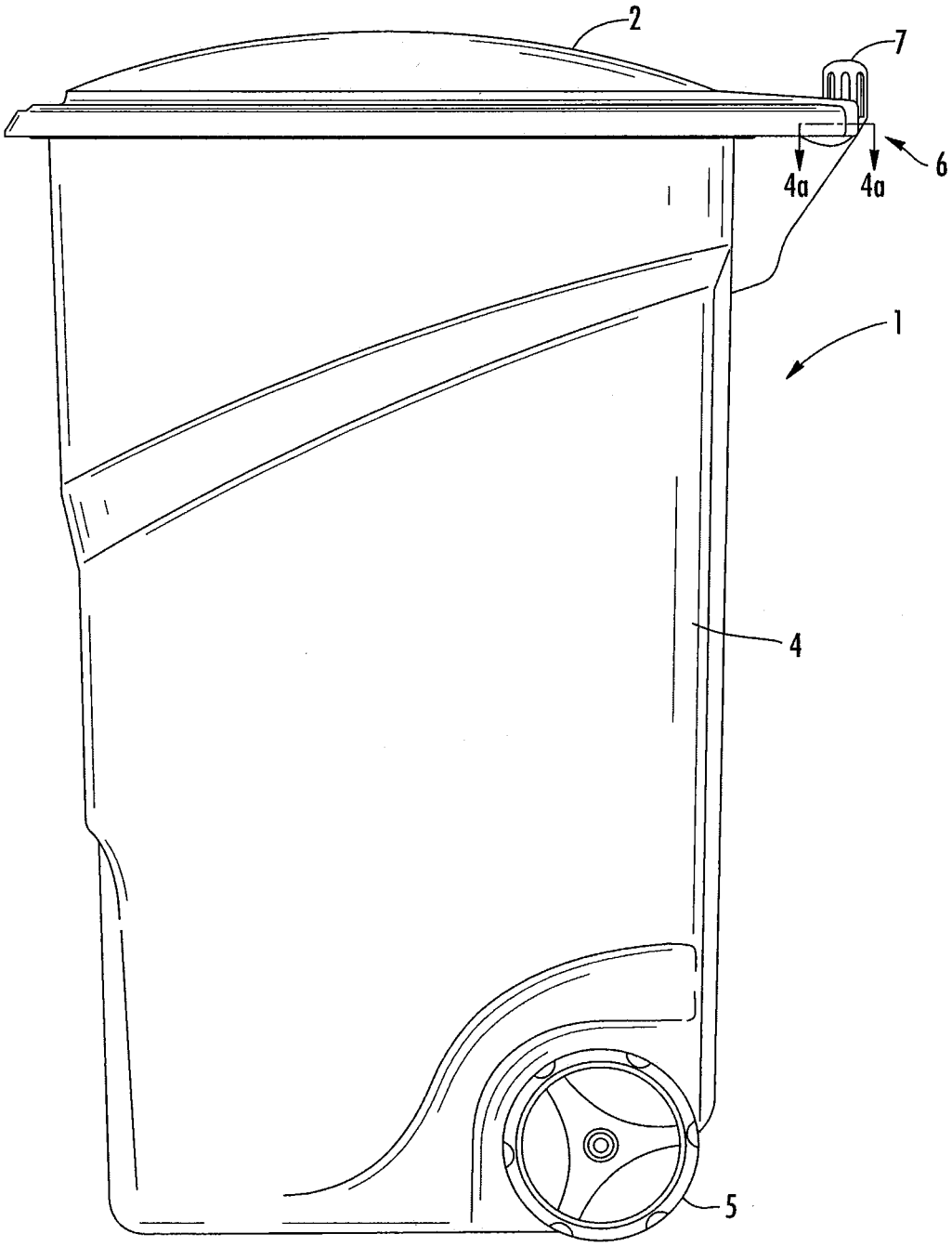
FIG. 1 is a side view of an embodiment of a refuse container showing the hinge and lid in the closed position.

The hinge of the invention allows a lid to assume a closed position and multiple open positions. In one embodiment the hinge is used on a container such as a refuse container and can assume a first position where the lid is in a first open position in a vertical or almost vertical orientation and a second position where the lid is in a second open position where the lid is fully open. In the fully open position the lid may open approximately 270 degrees from the closed position. A cam feature in the hinge is used to allow the lid to rotate between the semi-locked first open position, the second open position and the closed position. This semi-locked first open position is easily overcome by the user, allowing the user to easily open the lid to the second open position or to close the lid to the fully closed position. The hinge may be used on any container that has a lid that opens. In one embodiment the lid and receptacle may be made of a rigid material such as molded plastic. The illustrated embodiment shows the hinge on a plastic refuse container.

An embodiment of a refuse container 1 illustrating the structure and operation of the hinge is shown in FIGS. 1 through 3 and 9. The refuse container 1 comprises a receptacle 4 and a lid 2 pivoted to receptacle 4 at hinge 6. The receptacle 4 comprises a vertically extending wall or walls that define an interior space 9 for receiving refuse or other items. The wall(s) terminate in a rim 4*a* that defines the open upper end of receptacle 4 allowing access to the interior space 9. The receptacle 4 may be mounted on wheels 5 that allow the refuse container 1 to be tipped and rolled over the ground. While only one wheel 5 is shown a second coaxially mounted wheel is provided on the opposite side of the receptacle 4. Refuse container 1 may be provided with a greater or fewer number of wheels. A handle 7 may be provided near the upper end of the container 1 to facilitate moving the trash container 1 on wheels 5. The lid 2 is dimensioned to sit on top of rim 4*a* and cover the interior space 9 when the lid is in the closed position. While a specific embodiment of a refuse container 1 is shown, the refuse container may comprise any refuse container and may have a variety of configurations. Further, the hinge of the invention may be used to connect a lid to a receptacle in articles other than a refuse container.

Figure 2:
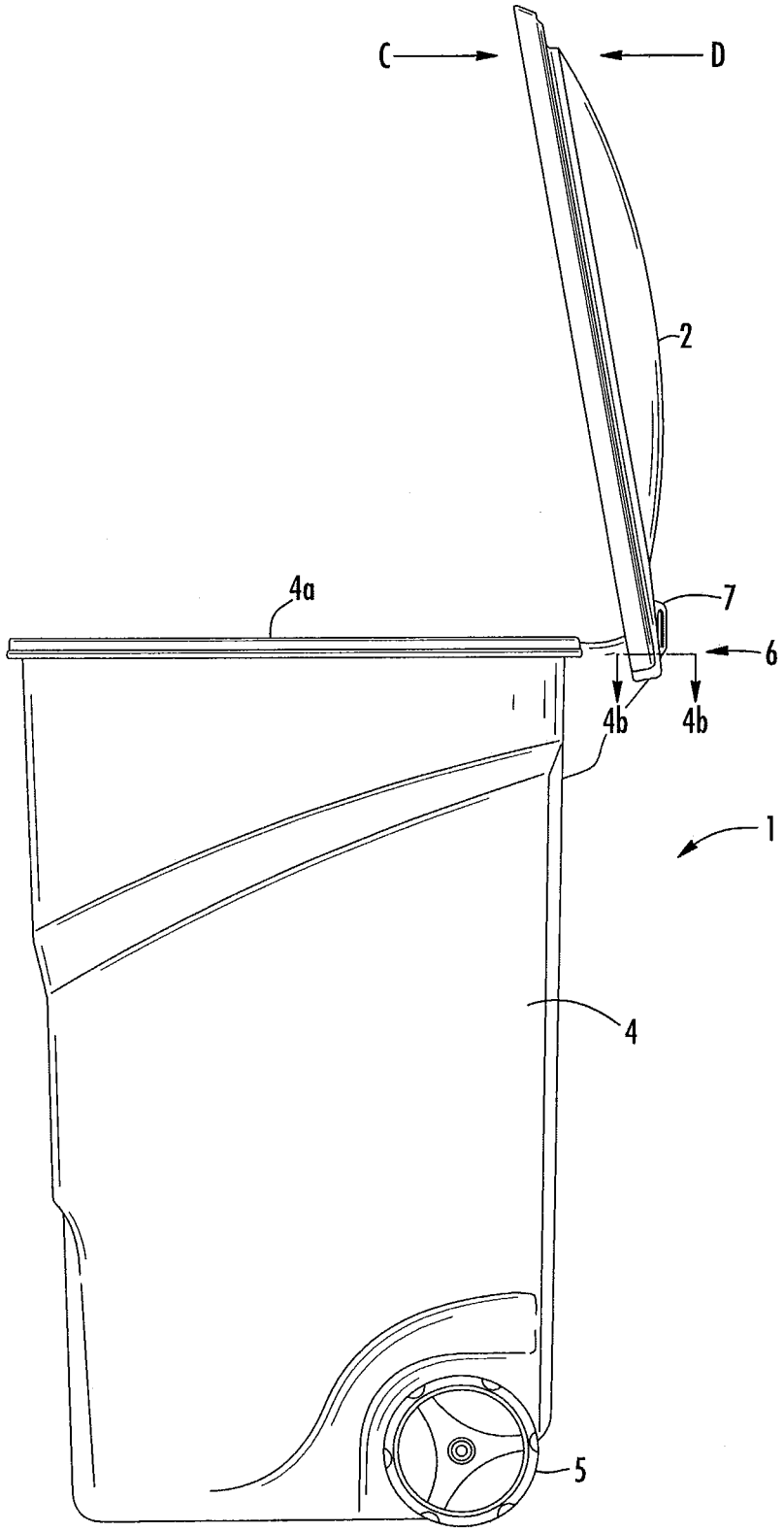
FIG. 2 is a side view of the refuse container of FIG. 1 showing the hinge and lid in a first open position.
Figure 3:
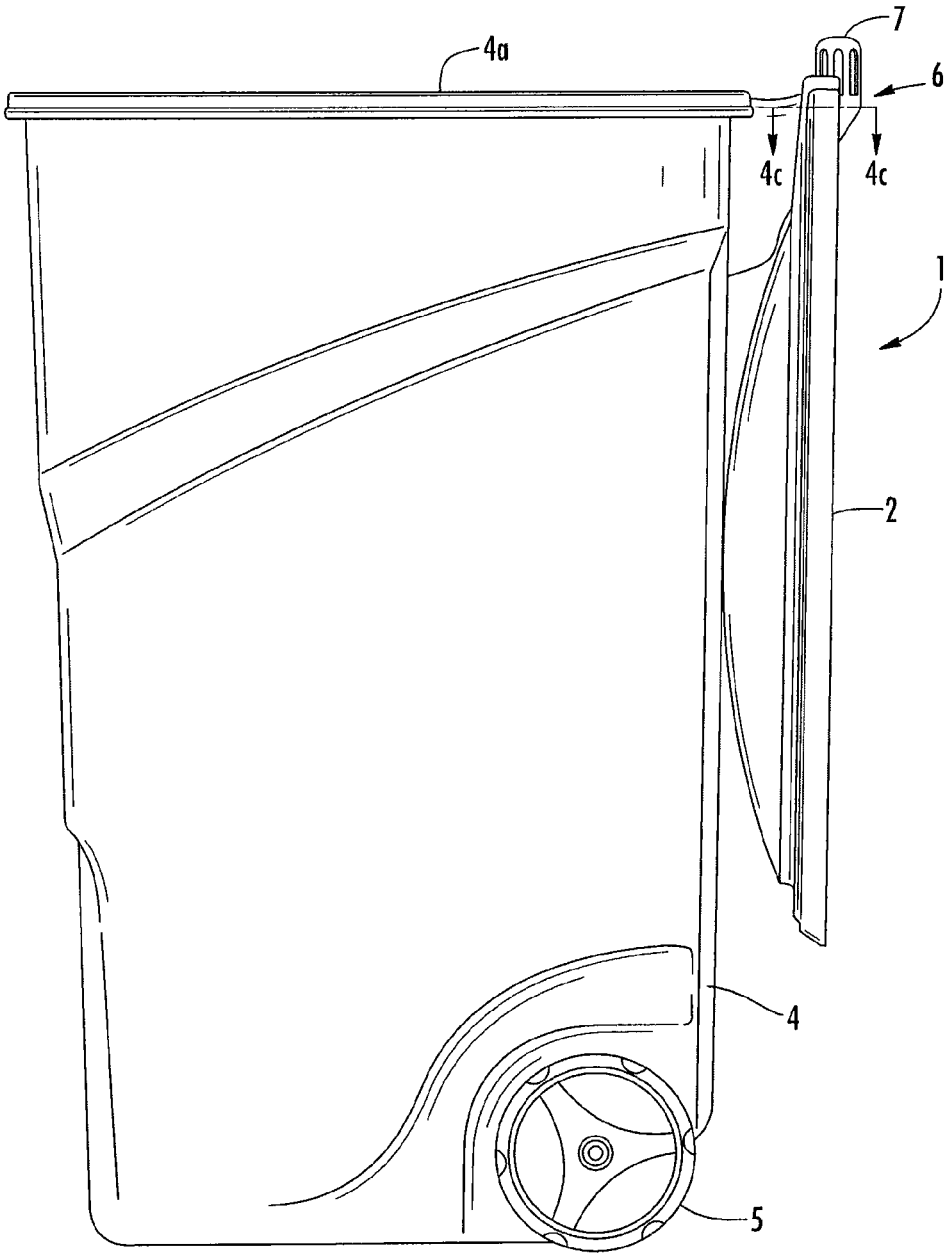
FIG. 3 is a side view of the refuse container of FIG. 1 showing the hinge and lid in a second open position.

Hinge 6 allows the lid 2 to move between the closed position of FIG. 1, the partially open first position of FIG. 2 and the fully open second open position of FIG. 3. FIG. 2 shows the lid 2 in the first open position that is referred to herein as the semi-locked position or the vertical/near vertical position. As shown in FIG. 2, the lid 2 is not completely vertical, however, in this position the lid 2 would otherwise fall to the closed position or fully open position under the force of gravity absent the multi-position hinge of the invention. In the first open position the lid 2 may occupy any open position relative to the receptacle 4 where the lid is held in position between the fully open position and the closed position. FIG. 3 shows the refuse container of FIG. 1 with the lid 2 in the second, fully open position. In this position the lid 2 is open to the point that it is suspended downwardly from hinge 6 and is held open under the force of gravity. In the fully open position, the lid 2 may be limited in the angle of opening by the engagement of the lid 2 with the container 4 or by use of another stop such that the lid may be suspended in an orientation other than vertical.

Figure 9:
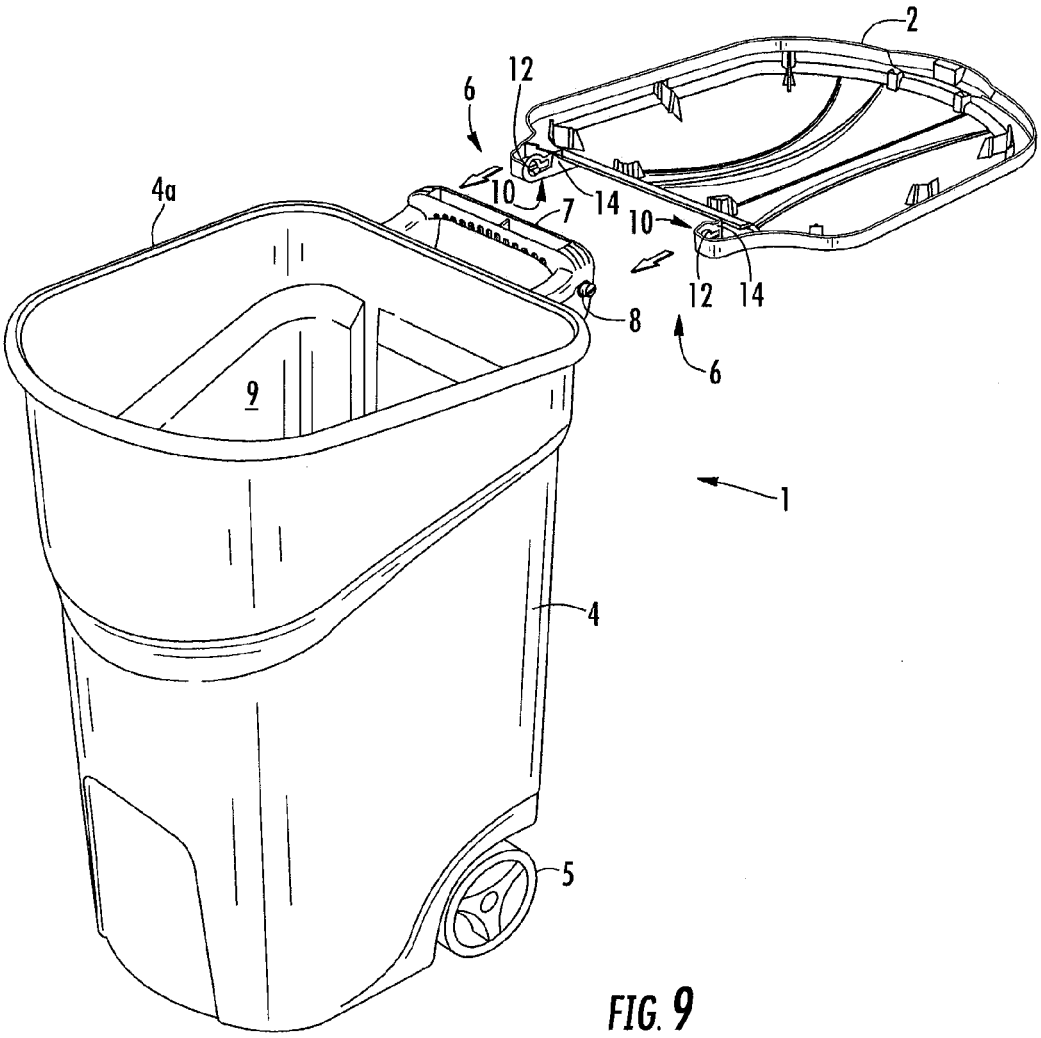
FIG. 9 is an exploded perspective view of the refuse container of FIG. 1 showing the hinge.
Figure 10:
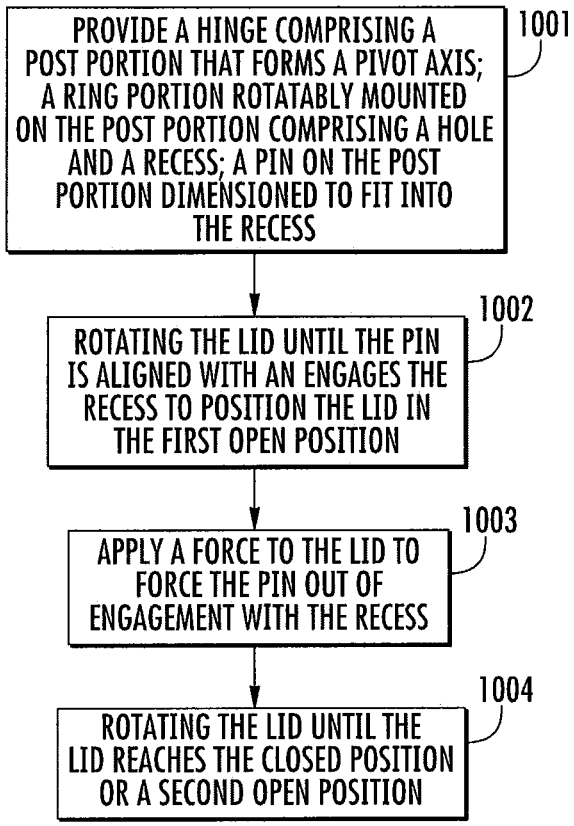
FIG. 10 is a block diagram illustrating an embodiment of a method of operating the hinge.

Referring to FIG. 9, the hinge 6 comprises a post portion 8 that is fixed to the receptacle 4 and forms the pivot axis for the lid 2. The hinge 6 further comprises a ring portion 10 rotatably mounted on the post portion 8. In the illustrated embodiment the ring portion 10 is connected to the lid 2 such that rotational movement of the lid 2 results in rotational motion of ring portion 10. The ring portion 10 comprises a circular hole 12 formed in a flange 14 that connects to the lid 2 where the post 8 is inserted into hole 12 such that the post 8 may freely rotate in hole 12. A recess 16 extends from the periphery of hole 12 to lock the lid 2 in the first open position as will hereinafter be described. In the illustrated embodiment two post portions 8 and two ring portions 10 are used to stably support the lid 2 on the receptacle 4, although a greater or fewer number of post portions 8 and ring portions 10 may be used.

Figure 4A:
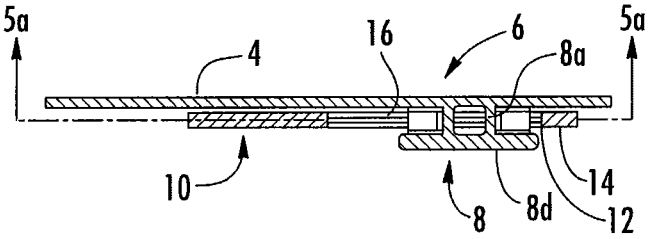
FIGS. 4*a*-4*c* are section views taken along line 4*a*-4*a* of FIG. 1, line 4*b*-4*b* of FIG. 2 and line 4*c*-4*c* of FIG. 3, respectively, showing an embodiment of the hinge in the closed position, first open position and second open position.
Figure 5A:
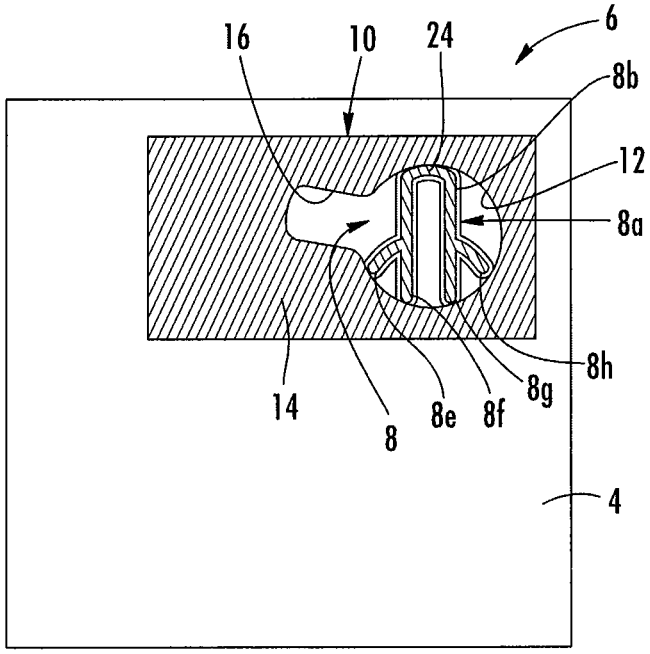
FIGS. 5*a*-5*c* are section views taken along line 5*a*-5*a* of FIG. 4*a*, line 5*b*-5*b* of FIG. 4*b* and line 5*c*-5*c* of FIG. 4*c*, respectively.
Figure 4B:
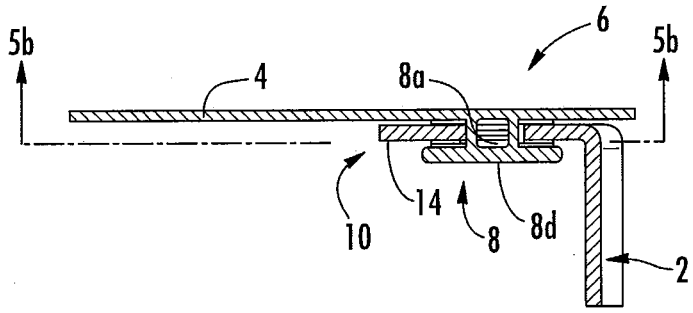
Figure 5B:
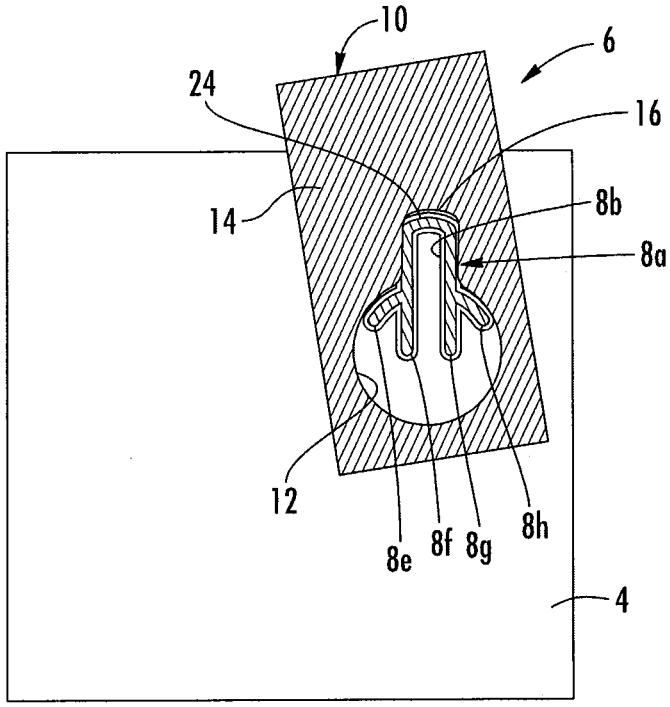

Referring to FIGS. 4*a*-4*c* and 5*a*-5*c*, the post portion 8 has a hinge post 8*a* that fits into hole 12 and an enlarged cap 8*d* that maintains the flange 14 on the hinge post 8*a*. Hinge post 8*a* is dimensioned such that the peripheral portion of the post 8*a* defines a cylindrical pivot that contacts or nearly contacts the peripheral wall of hole 12, as shown, for example, in FIG. 5*a*. Post 8*a* is configured such that it includes a projection or pin 8*b* that is dimensioned to fit into recess 16 of hole 12. The outer wall 24 of pin 8*b* defines a portion of the periphery of the cylinder defined by post 8*a* on which the peripheral wall of hole 12 rotates. In the illustrated embodiment, the pin 8*b* forms a first portion of the periphery of the post 8*a* and base section 8*e*, 8*f*, 8*g* and 8*h* forms the remaining periphery of post 8*a*. Together pin 8*b* and base section 8*e*, 8*f*, 8*g* and 8*h* define a cylindrical pivot over which the flange 14 is able to freely rotate. The pin 8*b* is located within the theoretical cylindrical pivot. Base section 8*e*, 8*f*, 8*g* and 8*h* are separate from the pin 8*b* such that pin 8*b* extends from the center of post 8*a* and is unobstructed on both sides. The base section 8*e*, 8*f*, 8*g* and 8*h* is formed by a first member 8*e* and a second member 8*h* that are dimensioned to conform to the periphery of hole 12 adjacent recessed portion 16 when pin 8*b* is in recessed portion 16 as shown in FIG. 5*b*. While the base section is formed of separate extending members 8*e*, 8*f*, 8*g* and 8*h*, the base section could be formed as a solid element.

Figure 4C:
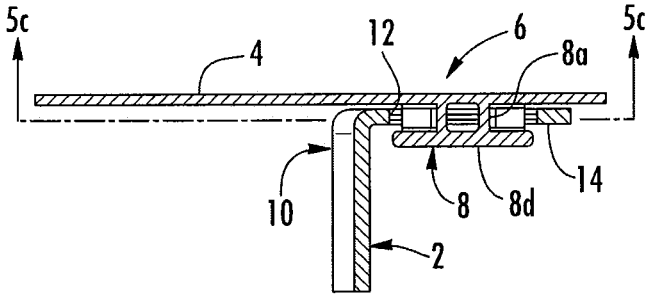
Figure 5C:
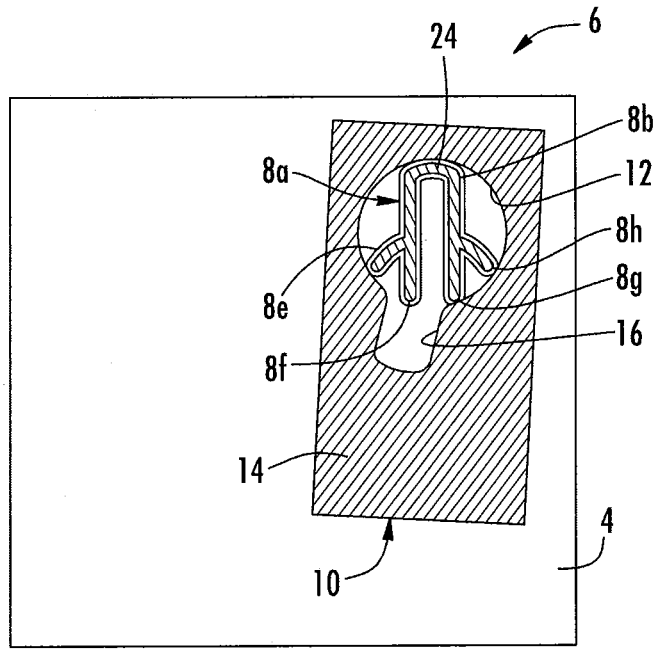
Figure 6A:
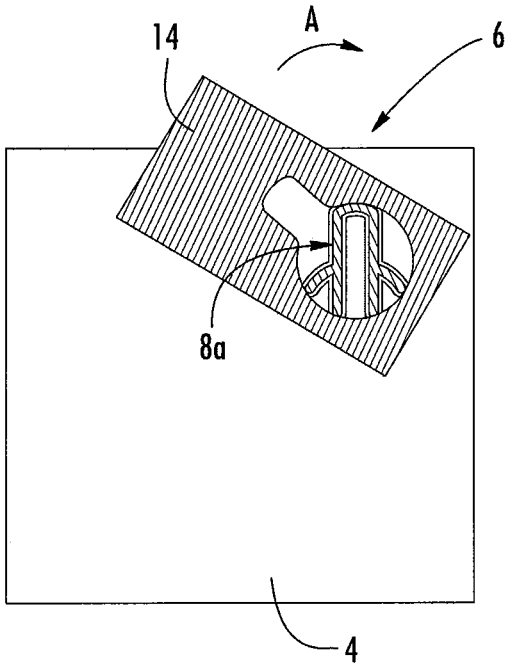
FIGS. 6*a*-6*e* are views similar to FIGS. 5*a*-5*c* showing the sequence of motion of the hinge as the lid moves between the closed position and the second open position.
Figure 6B:
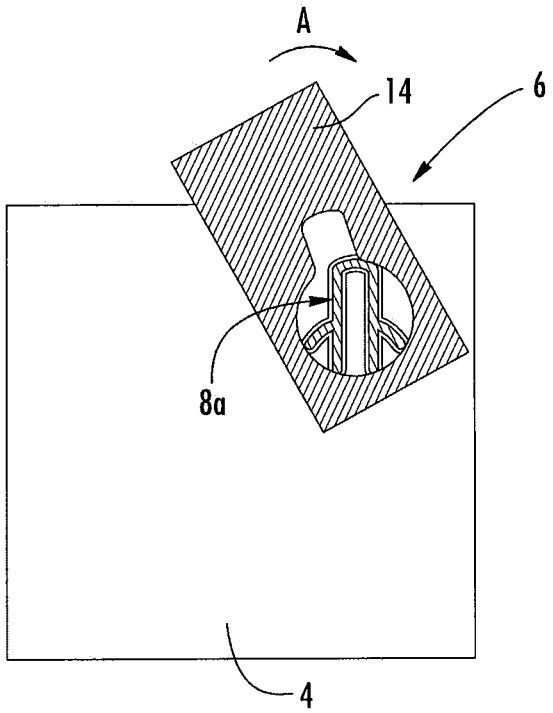

FIGS. 4*a*-4*c* and 5*a*-5*c* show the orientation of the hole 12 relative to the hinge post 8*a* in the closed position, first open position and second open position. FIGS. 6*a* through 6*e* show the orientation of the hinge 6 as the lid 2 is rotated (as represented by arrow A) from a near closed position past the first open position and toward the second open position. Movement of the hinge as the lid is rotated from the second open position, past the first open position and to the closed position is illustrated by viewing FIGS. 6*a*-6*e* in reverse order. In the closed position the periphery of post 8*a* engages the periphery of hole 12 as shown in FIGS. 4*a* and 5*a*. In the closed position lid 2 is substantially horizontal and is held against the rim 4*a* of receptacle 4 such as by gravity. To open the lid 2, the user grasps the lid 2 and manually rotates the lid toward the open position as shown in FIGS. 6*a* and 6*b*. As the lid 2 rotates toward the open position, flange 14 and hole 12 rotate relative to post 8*a* (clockwise as viewed in FIGS. 5 and 6) as hole 12 rotates over hinge post 8*a*. Because the exterior surfaces of post 8*a* define a cylindrical pivot that is concentric with the hole 12, the flange 14 rotates smoothly on post 8*a* as the lid 2 is rotated from the closed position toward the first open position. FIG. 6*b* shows the position of the hinge 6 just prior to the lid reaching the first open position.

When the pin 8*b* becomes aligned with recess 16, the lid 2 drops down relative to post 8*a* such that the pin 8*b* enters recess 16, as shown in FIGS. 4*b* and 5*b*, such that the lid 2 is held in the first open position. With the pin 8*b* engaged with recess 16, the periphery of hole 12 adjacent recess 16 sits on or closely adjacent to members 8*e* and 8*h*. The engagement of pin 8*b* with recess 16 prevents flange 14 from rotating relative to the post 8*a* and prevents the lid 2 from rotating relative to the receptacle 4. The lid can 2 be maintained in the first open position shown in FIGS. 2, 4*b* and 5*b* in a hands-free manner.

Figure 6C:
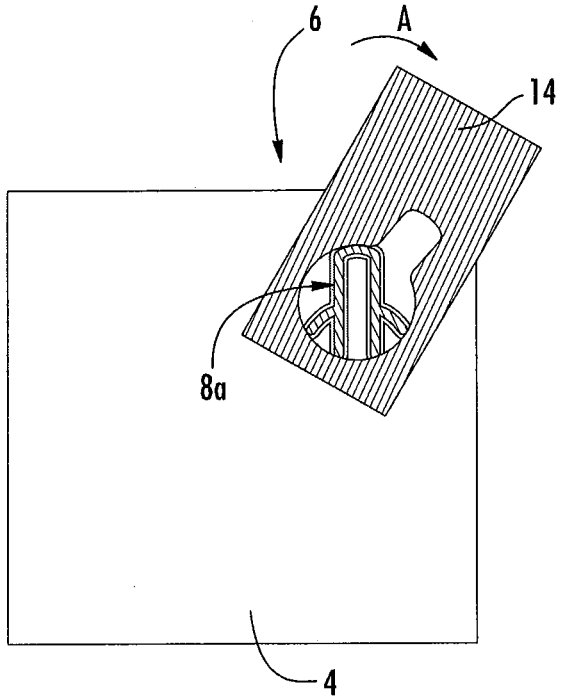
Figure 6D:
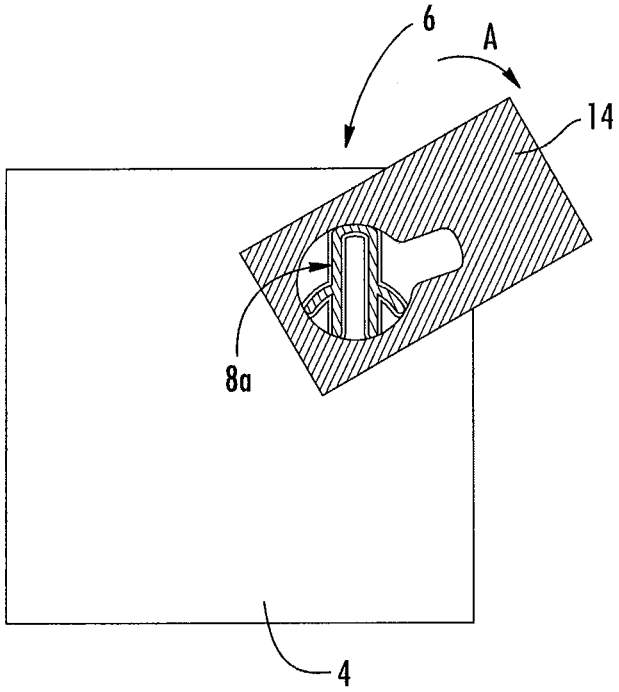
Figure 6E:
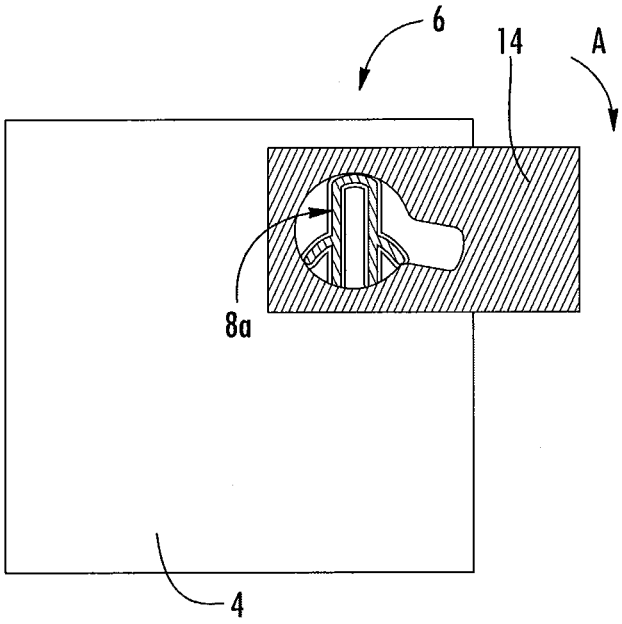

To move the lid from the first open position (FIGS. 2 and 5*b*) to either the closed position (FIGS. 1 and 5*a*) or the second open position (FIGS. 3 and 5*c*), the user pushes on lid 2 in the desired direction (FIG. 2, open arrow C or closed arrow D). The force exerted on the lid may be approximately perpendicular to the lid. The force exerted on the lid, causes the pin 8*b* to act as a cam and the recess 16 to act as a cam follower forcing the flange 14 (and lid 2) away from post 8*a* until the pin 8*b* is withdrawn from the recess 16. The user may also lift up on the lid 2 to remove the pin 8*b* from recess 16. Once the pin 8*b* is removed from recess 16, lid 2 and flange 14 can be rotated toward either the closed position, as shown in FIGS. 6*b* and 6*a*, or the second open position, as shown in FIGS. 6*c*, 6*d* and 6*e*. FIGS. 4*c* and 5*c* show the hinge in a fully open position where the lid 2 is suspended from the hinge 6.

Figure 7:
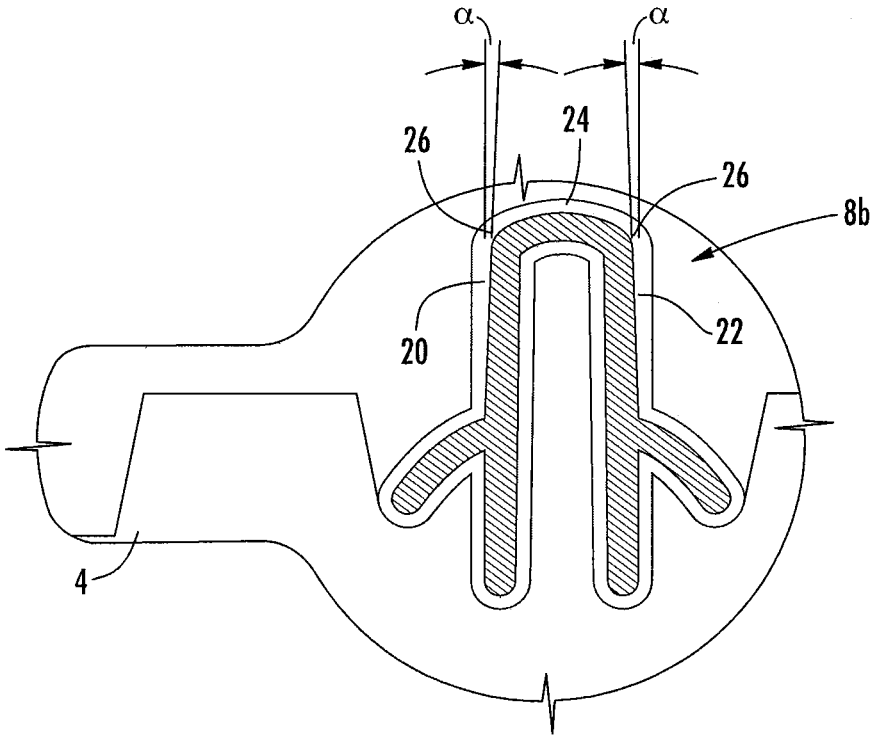
FIG. 7 is a detailed view of an embodiment of the hinge pin.

Referring to FIG. 7, the pin 8*b* is formed with rounds and a draft angle to control the ease with which the pin 8*b* is removed from the recess 16 when a force is applied to the lid. The leading wall 20 and trailing wall 22 of pin 8*b* are formed with a slight draft angle $\alpha$ where the walls are angled toward one another. The draft angle is the angle the walls form with a theoretical line that extends through the center of the post 8*a* and bisects the theoretical circle defined by the post 8*a*. In the illustrated embodiment, each of the leading wall 20 and trailing wall 22 are formed with a draft angle of approximately 1 degree such that the walls extend toward each other at approximately a 2 degree angle. Outer peripheral wall 24 meets the walls 20 and 22 at rounds 26. The rounds 26 are formed with a radius of 0.075 inches. The rounds 26 and draft angles $\alpha$ can be varied to control how much force must be applied to the lid in the direction of arrows C or D to cause the camming action between the pin 8*b* and the recess 16 that will force the lid away from the post 8*a* and the pin 8*b* out of recess 16.

Figure 8:
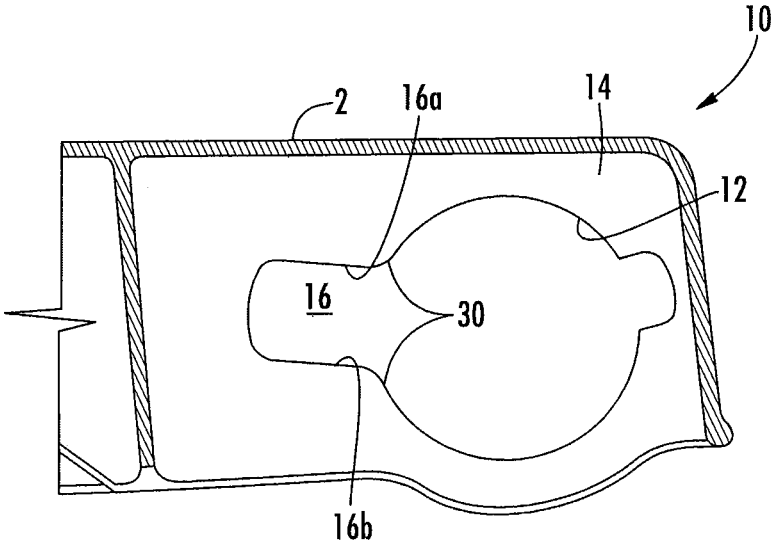
FIG. 8 is a detailed view of an embodiment of the ring portion.

Referring to FIG. 8, ring portion 10 is formed with rounds 30 between the side walls 16*a* and 16*b* of recess 16 and the adjacent peripheral wall portion of hole 12. The radius of these rounds can also be varied to control the ease with which the pin 8*b* is disengaged from the recess 16.

In a typical use the hinge may include multiple posts 8 and multiple ring portions 10 to create a sufficiently strong hinge. Further, the posts 8 may be formed on the lid and the ring portions 10 formed on the receptacle 4. While the hinge is shown with first and second open positions, multiple pins 8*b* may be provided on the post 8*a* such that more than one intermediate open position may be provided.

A method of operating a lid pivotably attached to a receptacle comprises providing a hinge for connecting the lid to the receptacle comprising a post portion that forms a pivot axis for a lid; a ring portion rotatably mounted on the post portion comprising a hole having a recess extending from the periphery of hole, said hole receiving said post portion; and a pin on said post portion dimensioned to fit into the recess when said recess rotates into alignment with the hinge pin (block 1001). The lid is rotated until the pin engages the recess to position the lid in the first open position (block 1002). A force is applied to the lid to force the pin out of engagement with the recess (block 1003). The lid is rotated until the lid reaches the closed position or the second open position (block 1004).

While embodiments of the invention are disclosed herein, various changes and modifications can be made without departing from the spirit and scope of the invention as set forth in the claims. One of ordinary skill in the art will recognize that the invention has other applications in other environments. Many embodiments are possible. The following claims are in no way intended to limit the scope of the invention to the specific embodiments described above.

The invention claimed is:

1. A trash container comprising:

a receptacle;

a lid pivotably mounted to the receptacle at a hinge;

the hinge comprising a post that forms a pivot axis for the lid where the lid may pivot between a closed position and an open position relative to the receptacle about the pivot axis;

a ring portion on the lid, the ring portion being rotatably mounted on the post and comprising a hole having a periphery and a recess extending from the periphery of hole, said hole receiving said post;

the post comprising a base that defines a first portion of a cylindrical pivot and a pin that projects outwardly from the base and defines a second portion of the cylindrical pivot, the base comprising at least one outwardly extending arm that movably engages the periphery of the hole such that the periphery of the hole rotates on the cylindrical pivot as the lid pivots between the closed position and the open position, the pin being insertable into the recess by moving the lid relative to the post in a first direction when the recess rotates into alignment with the pin, wherein engagement of the pin with the recess locks the lid in the open position relative to the receptacle;

the pin having a peripheral wall, a first wall, and a second wall, wherein the first and second walls engage first and second sidewalls of the recess, respectively, when the lid is locked in the open position, the first wall being angled toward the second wall and the first wall and the second wall being joined to the peripheral wall by rounds, such that when the lid is in the open position and a force is applied opposite to the first direction, the pin acts on the recess to force the pin out of the recess, thereby allowing the lid to pivot from the open position to the closed position.

2. The trash container of claim 1 wherein at least one of the first wall and the second wall form an angle with a theoretical line that extends through the center of the post.

3. The trash container of claim 2 wherein the angle is approximately 1 degree.

4. The trash container of claim 1 wherein when the lid is in the closed position the lid rests on the receptacle.

5. The trash container of claim 1 wherein when the lid is in the open position the lid is spaced from the receptacle.

6. The trash container of claim 1 wherein the lid is movable to a second open position when the pin is removed from the recess.

7. The trash container of claim 1 further comprising a wheel on which the receptacle is mounted.

8. The trash container of claim 1 further comprising a handle mounted to the receptacle.

9. A trash container comprising:

a receptacle;

a lid pivotably mounted to the receptacle;

a post that forms a pivot axis for the lid;

a ring portion on the lid, the ring portion being rotatably mounted on the post and comprising a hole having a periphery and a recess extending from the periphery of hole, the hole receiving the post such that the lid is pivotable approximately 270 degrees relative to the receptacle between a fully open position and a fully closed position;

the post comprising a base that defines a first portion of a cylindrical pivot and a pin that projects outwardly from the base and defines a second portion of the cylindrical pivot, the base comprising at least one outwardly extending arm that movably engages the periphery of the hole such that the periphery of the hole rotates on the cylindrical pivot as the lid pivots between the fully closed position and the fully open position, the pin being insertable into the recess by moving the pivot axis of the lid relative to the post when the recess rotates into alignment with the hinge pin, wherein engagement of the pin with the recess locks the lid in a partially open position relative to the receptacle.

10. A method of operating a lid pivotably attached to a receptacle, the method comprising;

providing a hinge for connecting the lid to the receptacle, the hinge comprising a post that forms a pivot axis for a lid and a ring portion on the lid, the ring portion being rotatably mounted on the post and comprising a hole having a periphery and a recess extending from the periphery of hole, the hole receiving the post such that the lid is pivotable approximately 270 degrees relative to the receptacle between a fully open position and a fully closed position, the post comprising a base that defines a first portion of a cylindrical pivot and a pin that projects outwardly from the base and defines a second portion of the cylindrical pivot, the base comprising at least one outwardly extending arm that movably engages the periphery of the hole such that the periphery of the hole rotates on the cylindrical pivot as the lid pivots between the fully closed position and the fully open position, the post being dimensioned to fit into the recess when the recess rotates into alignment with the pin;

rotating the lid until the pin is aligned with the recess to position the lid in a partially open position and inserting the pin into the recess by moving the pivot axis of the lid relative to the post in a first direction;

applying a force to the lid opposite to the first direction to force the pin out of engagement with the recess; and rotating the lid until the lid is in the fully closed position or the fully open position.

11. The trash container of claim 9 wherein the pin has a first wall and a second wall where the first wall and the second wall engage a first sidewall and a second sidewall of the recess, respectively, the first wall being angled toward the second wall.

12. The trash container of claim 11 wherein and the first wall and the second wall are joined to a peripheral wall by rounds.

13. The trash container of claim 11 wherein at least one of the first wall and the second wall form an angle with a theoretical line that extends through the center of the post.

14. The trash container of claim 13 wherein the angle is approximately 1 degree.

15. The trash container of claim 1, wherein the base comprises a pair of outwardly extending arms that movably engage the periphery of the hole.

16. The trash container of claim 1, wherein the first and second walls of the pin engage the periphery of the hole when the lid is in the open position.

17. The trash container of claim 1, wherein the base comprises a pair of outwardly extending arms that movably engage the periphery of the hole.

18. The trash container of claim 1, wherein the pin comprises first and second walls, and wherein the first and second walls engage the periphery of the hole when the lid is in the open position and engage first and second sidewalls, respectively, of the recess when the lid is locked in the partially open position.

* * * * *